US005940348A

United States Patent [19]

Murakami et al.

[11] Patent Number: 5,940,348

[45] Date of Patent: Aug. 17, 1999

[54] ELECTRONIC TIMEPIECE

[75] Inventors: Tomomi Murakami; Masakazu Ichikawa; Norio Miyauchi, all of Tanashi, Japan

[73] Assignee: Citizen Watch Co., Ltd., Tokyo, Japan

[21] Appl. No.: 09/066,372

[22] PCT Filed: Aug. 29, 1997

[86] PCT No.: PCT/JP97/03034

§ 371 Date: Apr. 30, 1998

§ 102(e) Date: Apr. 30, 1998

[87] PCT Pub. No.: WO98/09202

PCT Pub. Date: Mar. 5, 1998

[30] Foreign Application Priority Data

Aug. 30, 1996 [JP] Japan ..... 8-229609

[51] Int. Cl.[6] ..... G04B 47/06; G04B 9/00; G04B 23/02

[52] U.S. Cl. ..... 368/11; 368/66; 368/73; 368/80

[58] Field of Search ..... 368/10, 11, 72–74, 368/203–204, 250

[56] References Cited

U.S. PATENT DOCUMENTS

| | | | |
|---|---|---|---|
| 4,316,274 | 2/1982 | Ushikoshi | 368/66 |
| 4,398,832 | 8/1983 | Maire et al. | 368/66 |
| 4,690,568 | 9/1987 | Odagiri et al. | 368/204 |

FOREIGN PATENT DOCUMENTS

| | | |
|---|---|---|
| 54-87268 | 7/1979 | Japan . |
| 58-92881 | 6/1983 | Japan . |
| 58-145596 | 9/1983 | Japan . |
| 59-40191 | 3/1984 | Japan . |
| 63-100396 | 5/1988 | Japan . |
| 3-25190 | 3/1991 | Japan . |
| 6-12990 | 2/1994 | Japan . |

*Primary Examiner*—Vit Miska
*Attorney, Agent, or Firm*—Kanesaka & Takeuchi

[57] ABSTRACT

An electronic timepiece in accordance with the present invention includes a time clocking circuit for counting reference signals from a reference signal generating circuit to provide time information as its output; a warning device for warning the user of a specific time, by use of vibrations or a buzzer, on the basis of time information derived from the time clocking circuit; and a timepiece state detection device for detecting the states of the temperature and the power source voltage of the timepiece and, if the detection values deviate from predetermined values, the detection device operates to stop the warning action of the warning means. The timings of time information derived from the time clocking circuit differ from each other between when the timepiece state detection device has detected a low temperature of the timepiece and when it has detected a low voltage at the power source, and differ from the time information timing at the normal state. This prevents any batteries' consumption which may otherwise be caused by the meaningless warning, and makes it possible to inform the user of the states of the timepiece through the movement of the hands.

9 Claims, 2 Drawing Sheets

ELECTRONIC TIMEPIECE

TECHNICAL FIELD

The present invention relates generally to an electronic timepiece equipped with additional functions such as an alarm function, and more particularly to an electronic timepiece ensuring effective utilization of a battery acting as a power source for the electronic timepiece and having a capacity to inform the user of the state of the battery and the temperature in the electronic timepiece.

BACKGROUND ART

It is desirable that the electronic timepieces using the batteries display time as long as possible without need to change the batteries. For this reason, used in the electronic timepieces, particularly in electronic wristwatches desired to be extremely small and thin are batteries having a very low self discharge rate and a less self degradation in spite of the long-term use.

Therefore, prevailing wristwatches are designed so that most of the functions included in the electronic timepieces operates with a minimum amount of electrical current and that the operation is averaged to allow a single battery to provide a time display for two or three years. Major wristwatches with the alarm function for instance make use of a piezoelectric device-actuated buzzer. In this type of timepieces, the piezoelectric device-actuated buzzer often uses a maximum instantaneous current of about 7 mA and an average current of about 2 mA, which enables it to have a battery life of more than two years if the alarm is used once a day.

Another type of electronic timepiece has also been developed and commercially available which employs as the alarm function not only noise warning means operated by the piezoelectric buzzer but also noiseless warning means operated by a vibration motor.

However, the electrical current required to start the vibration motor, even when using a low electricity consuming motor, is 15 mA or more, and even when it runs at its steady speed, 5 mA is required.

On the other hand, silver or lithium batteries utilized in general by wristwatches produce only a limited amount of electricity flow due to their high internal impedance values. On top of this, at low temperatures of 5° C. or below these batteries' internal impedance rises, making it difficult to derive the electrical current therefrom.

Thus, if the vibration motor is started when the temperature is below 5° C., the battery voltage levels suddenly drop and even the operation of the time clocking circuit becomes stressed, the hands on the watch stop moving.

However, when the watch is worn on the wrist, it is usual for the watch itself to have a temperature of about 30° C. due to the heat radiated from the wearer's body, although the temperature of the watch itself may drop to 5° C. or below if the watch worn on the wrist is in cold water or if the watch is left at a low temperature, in which occasion the vibration motor's silent alarm is not particularly necessary. In this situation starting the vibration motor results in an unnecessary waste of the batteries and also needlessly shortens the watch's battery life.

In addition, in case a watch user has been aware that the vibration motor of the watch being left for some time has stopped, confusion could be avoided, if the owner could tell whether the vibration motor has stopped due to a dead battery or the temperature.

DISCLOSURE OF THE INVENTION

It is therefore the object of the present invention to provide an electronic timepiece which prevents any unnecessary waste of batteries and indicates to the user the present state of the batteries and temperature in the timepiece through the manner of movement of the hands on the timepiece.

An electronic timepiece in accordance with the present invention comprises a reference signal generating circuit for generating reference signals; a time clocking circuit for counting the reference signals to provide time information as its output; warning means for warning the user of a specific time on the basis of the time information derived from the time clocking circuit; and detection means for detecting the state of the timepiece and, if the detected value deviates from a predetermined value, bringing the action of the warning means to a stop; the warning means including noise warning means comprised of a buzzer and silent warning means comprised of a vibration motor, wherein the state of the temperature and the power source voltage in the timepiece is detected.

It is thus possible to prohibit the operation of the vibration motor which requires large volumes of electrical current, in a low temperature state where the batteries are incapable of discharging the large volumes of current due to their characteristics, thereby ensuring a precise hand movement which is a duty of the timepiece.

Furthermore, the second hand movement mode at the low battery voltage is caused to differ from that at the low temperature so that the user can tell whether the vibration motor does not operate due to short battery life or due to low temperature.

BEST MODE FOR CARRYING OUT THE INVENTION

With reference to the accompanying drawings, description will now be made for an embodiment in which the present invention is applied to an analog display type electronic timepiece.

Figure 1:
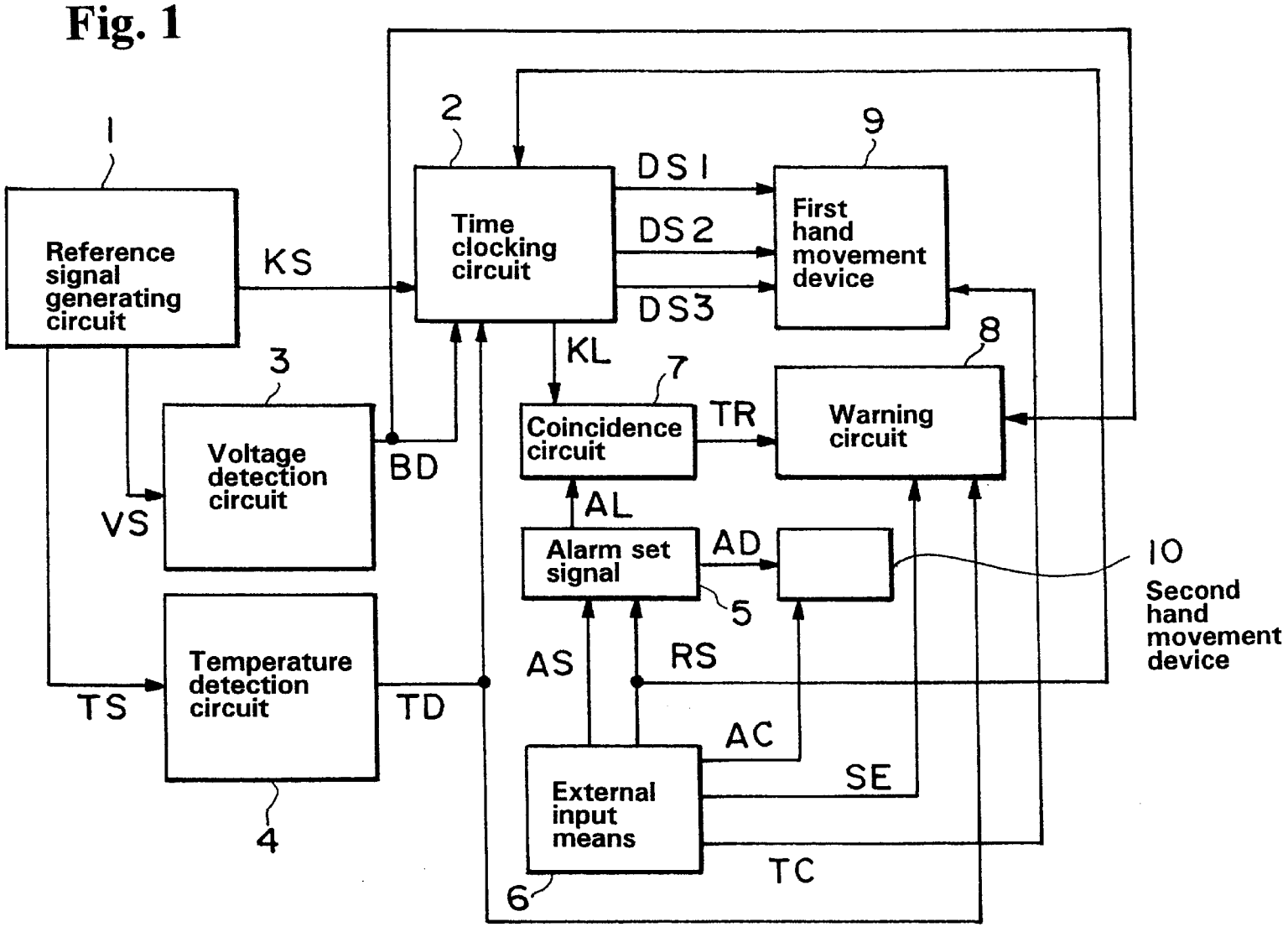
FIG. 1 is a block diagram of a circuit part in an analog display type electronic timepiece showing an embodiment of the present invention.
Figure 2A:
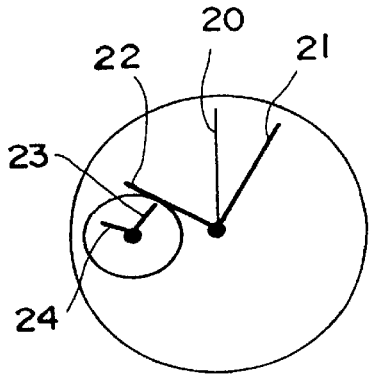
FIGS. 2(*a*) and 2(*b*) are schematic top plan views of the analog display type electronic timepiece.
Figure 2B:
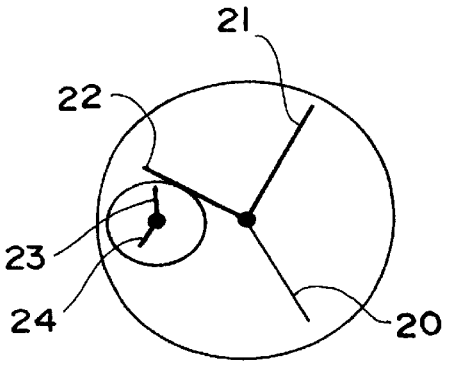
Figure 3:
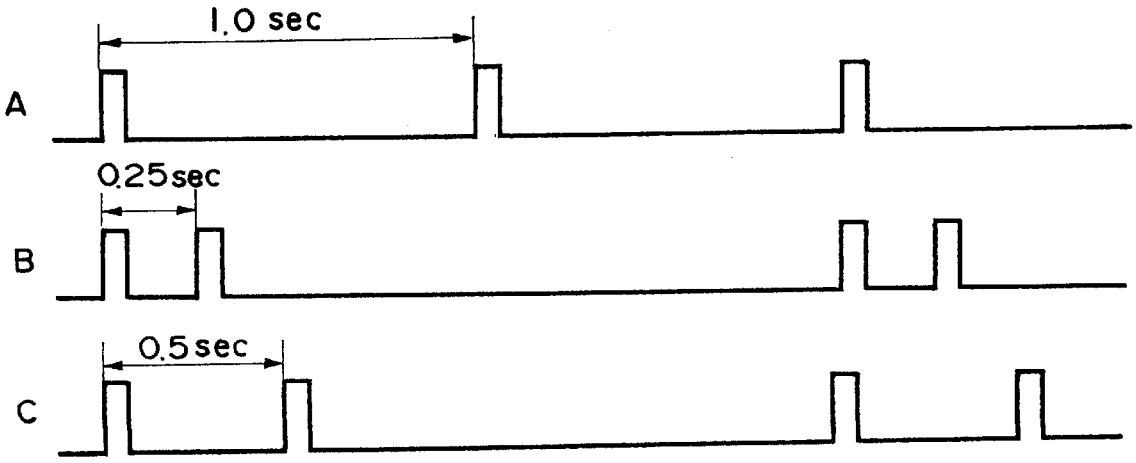
FIG. 3 shows waveforms of hand movement signals DS1, DS2 and DS3.

FIG. 1 is a block diagram of a circuit part in the electronic timepiece with vibration alarm function in accordance with this embodiment. FIG. 2 is a top plan view illustrating a display face of the electronic timepiece shown in FIG. 1. FIG. 3 is a signal waveform diagram illustrating outputs of hand movement signals DS in respective states shown in FIG. 1.

Referring first to FIG. 1, a reference signal generating circuit 1 provides as its outputs a hand movement reference signal KS providing a time reference for movements of the hands on the timepiece, a temperature detection timing signal TS indicating the timing at which a detection of the temperature is performed, and a voltage detection timing signal VS indicating the timing at which a detection of the battery voltage is performed.

A time clocking circuit 2 receives as its input the hand movement reference signal KS and provides as its outputs hand movement signals DS1, DS2 and DS3 at a cycle of one second in the ordinary state. Upon a receipt of a reset signal RS, the time clocking circuit 2 is reset to cease from outputting the hand movement signals DS1, DS2 and DS3. Furthermore, the time clocking circuit 2 counts the hand movement reference signal KS to output time data KL on a minute basis. These time data KL represent a count number per minute from a point of time when the reset signal RS has been cleared.

A voltage detection circuit 3 detects the voltage of a battery not shown when it receives the voltage detection timing signal VS from the reference signal generating circuit 1. The voltage detection circuit 3 provides as its output a voltage drop signal BD when the detected battery voltage is a predetermined voltage or below.

A temperature detection circuit 4 detects the temperature of the timepiece when it receives as its input the temperature detection timing signal TS from the reference signal generating circuit 1. Furthermore, the temperature detection circuit 4 provides as its output a temperature drop signal TD when the detected temperature is a predetermined temperature or below.

The time clocking circuit 2 provides as its outputs the hand movement signal DS2 indicative of a drop in the voltage when it receives the voltage drop signal BD from the voltage detection circuit 3, the hand movement signal DS3 indicative of a drop in the temperature when it receives the temperature drop signal TD from the temperature detection circuit 4, and the hand movement signal DS1 in other normal states. FIG. 3 illustrates waveforms of the hand movement signals DS1, DS2 and dS3 in their respective states.

In FIG. 3, A represents a waveform of the hand movement signal DS1 output at a cycle of one second in the normal state, B represents a waveform of the hand movement signal DS2 indicative of a drop in the battery voltage, with 0.25 sec. interval two pulses being output at a cycle of two seconds. C represents a waveform of the hand movement signal DS3 indicative of the state of a drop in the temperature, with 0.5 sec. Interval two pulses being output at a cycle of two seconds.

External input means 6 serves to output a reset signal RS, an alarm set signal AS, a time correction signal TC, an alarm correction signal AC and a selection signal SE.

An alarm counter 5 resets its content in response to a receipt of the reset signal RS issued from the external input means 6 to synchronize the time clocking circuit 2 with the alarm counter 5, and sets an alarm time when it receives the alarm set signal AS with no reset signal RS received. The alarm counter 5 serves to output an alarm time set by the external input means 6. The alarm counter 5 further provides as its output an alarm set signal AD each time the alarm time is set by the alarm set signal AS.

A coincidence circuit 7 provides as its output a coincidence signal TR when the alarm time AL from the alarm counter 5 is coincident with the time data KL from the time clocking circuit 2. A warning circuit 8 is allowed to operate in response to a receipt of the coincidence signal TR from the coincidence circuit. The warning circuit 8 receives as its input the selection signal SE issued from the external input means 6 and selects for operation either the buzzer based warning or vibration based warning on the basis of the selection signal.

It is to be appreciated that in case the warning circuit 8 has received the temperature drop signal TD from the temperature detection circuit 4, it is not allowed to operate in spite of the selection of the vibration based warning.

A first hand movement device 9 is a hand indicator mechanism for ordinary hand indicator type electronic timepiece and accepts a hand movement signal DS1 every one second to move a second hand 20. A second hand movement device 10 is a hand indicator mechanism for an alarm hand and accepts the alarm set signal AD from the alarm counter 5 to move the hand.

During the time when the reset signal RS is being issued from the external input means 6, display times of the first hand movement mechanism 9 and the second hand movement mechanism 10 are corrected by the time correction signal TC and the alarm correction signal AC issued from the external input means 6.

Referring then to FIGS. 2(*a*) and 2(*b*), the first hand movement device 9 consists of the second hand 20, a minute hand 21 and an hour hand 22, to thereby display a time. The second hand 20, minute hand 21 and hour hand 22 are linked with one another by way of a gear train in such a manner that the minute and hour hands move in interlock with the second hand. The second hand movement device 10 consists of an alarm minute hand 23 and an alarm hour hand 24, to thereby display an alarm set time. The alarm minute hand 23 and the alarm hour hand 24 are linked with each other by way of a gear train In such a manner that the alarm hour hand 24 moves in interlock with the alarm minute hand 23.

FIG. 2(*a*) illustrates a reset state, that is, a state in which the second hand 20, minute hand 21 and hour hand 22 for the time display are synchronized with the alarm minute hand 23 and alarm hour hand 24 for the alarm time. The second hand 20, minute hand 21 and hour hand 22 indicate a time 10:05'0", while the alarm minute hand 23 and alarm hour hand 24 indicate the same time 10:05. FIG. 2(*b*) illustrates a time display in the normal state. The second hand 20, minute hand 21 and hour hand 22 indicate a time 10:05'25", while the alarm minute hand 23 and alarm hour hand 24 indicate an alarm set time 7:00.

Description will be made for the operation of the thus configured electronic timepiece in accordance with this embodiment.

The external means 6 is first operated to issue a reset signal RS. Thus, the timepiece results in its reset state. In this state, a time correction signal TC and an alarm correction signal AC are used respectively to set the first hand movement device 9 for the time display and the second hand movement device 10 for the alarm time display to the current time. A time 10:05 is then indicated both by the second hand 20, minute hand 21 and hour hand 22 constituting the first hand movement device 9 and by the alarm minute hand 23 and alarm hour hand 24 constituting the second hand movement device 10, as shown in FIG. 2(*a*). The alarm counter 5 and the time clocking circuit 2 reset the content of the counter by use of a reset signal RS.

The external input means 6 are then operated to cancel the output of the reset signal RS. This allows the time clocking circuit 2 to start to issue a hand movement signal DS1 every one second as shown in FIG. 3A in response to an input of a hand movement reference signal KS. The first hand movement device 9 accepts the hand movement signal DS1 to start the time display. The time clocking circuit 2 further sends time data 3 every one minute to the coincidence circuit 7. In such conditions, ordinary hand movements for the time display are carried out.

In case of setting the alarm time, the external input means 6 are operated to provide an alarm set signal AS as its output to the alarm counter 5. The alarm counter 5 sets an alarm time AL in conformity with the alarm set signal AS. For instance, if the alarm counter 5 accepts a 535 pulse alarm set signal AS, the content of the counter is set to 535, allowing the alarm time AL to be provided as 535 to the coincidence circuit 7. The alarm counter 5 further provides 535 pieces of alarm set signals AD as its output to the second hand movement device 10. As a result, the second hand movement device 10 is allowed to indicate a time of 535 minutes later, i.e., eight hours and 55 minutes later from 10:05 of FIG. 2(*a*), that is, 7:00 shown in FIG. 2(*b*). The alarm time AL is set in minutes as described above.

Thus, when the count of the time data KL, the output of the time clocking circuit 2 reaches 535 with the elapse of time, the coincidence circuit 7 provides a coincidence signal TR as its output to the warning circuit 8. After the receipt of the coincident signal TR, the waning circuit 8 selects the warning method previously designated by the selection signal SE from the external input means 6, that is, either the buzzer-based warning or the vibration based warning, to perform the warning action.

The above operations are carried out in the ordinary state. Also, in the ordinary state, the reference signal generation circuit 1 sends a temperature detection timing signal TS at predetermined intervals of, e.g., one hour to the temperature detection circuit 4, and sends a voltage detection timing signal VS every five minutes to the voltage detection circuit 3. Upon the receipt of these signals, the temperature detection circuit 4 and the voltage detection circuit 3 perform their respective detecting actions and if the detected results are more than the predetermined detection values, both issue no signals.

In cases where the electronic timepiece is left alone at a low temperature, however, if it is judged that the detected temperature is the predetermined temperature or below, then the temperature detection circuit 4 feeds a temperature drop signal TD to both the time clocking circuit 2 and the warning circuit 8. The output of this temperature drop signal TD continues until the detection result is updated by the subsequent temperature detection timing signal TS. In response to a receipt of this temperature drop signal TD, the time clocking circuit 2 issues a hand movement signal DS3 shown in FIG. 3C. This allows the second hand 20 to move twice at 0.5 sec. interval in two second cycle, resulting in a hand movement mode different from that in the ordinary state.

The warning circuit 8 on the other hand prohibits the vibration based warning even though a coincidence signal TR has been received from the coincidence circuit 7 for the duration when the temperature drop signal TD is being input.

If the voltage detection circuit 3 judges that the battery voltage is a predetermined voltage value or below, it supplies voltage drop signals BD to both the time clocking circuit 2 and the warning circuit 8. The output of this voltage drop signal BD continues until the detection result is updated by the subsequent voltage detection timing signal VS. In response to a receipt of this voltage drop signal BD, the time clocking circuit 2 issues a hand movement signal DS2 shown in FIG. 3B. As a result of this, the second hand 20 is allowed to move twice at 0.25 sec. interval in two second cycle, resulting in a hand movement mode different from that in the ordinary state and the temperature drop state.

The warning circuit 8 on the other hand prohibits the vibration based warning and buzzer based warning even if the coincidence signal TR has been received from the coincidence circuit 7 during the time when the voltage drop signal BD is being input.

According to the electronic timepiece having the above configuration, any unnecessary waste of the battery is prevented and the user is warned of the state of the battery and the temperature in the timepiece by way of the manners of hand movements.

The present invention may be also useful in the following case. For instance, in case a plurality of persons wearing time pieces with buzzer alarm function have dived into the sea, even though one of their timepieces has issued an alarm, the wearers may not tell whose one has issued the alarm. This is due to the fact that the sound transmission speed in the water is about four times faster than that in the air so that there is little difference in times required for the sound to reach the right and left ears of wearers. This makes it difficult to tell the timepiece worn by which wearer has issued an alarm. That is, it is also possible to prohibit the vibration and/or buzzer based warning even in the case of using under the environment extremely different from the ordinary air pressure and to inform the user of the states by way of the hand movements.

INDUSTRIAL APPLICABILITY

The present invention is applicable to not only electronic wristwatches but also to various types of small-sized electronic equipment having an electronic timepiece function with alarm.

What is claimed is:

1. An electronic timepiece comprising:

a reference signal generating circuit for generating reference signals;

a time clocking circuit for counting the reference signals from said reference signal generating circuit to provide time information as its output;

warning means for warning a user of a specific time on a basis of time information derived from said time clocking circuit; and timepiece state detection means for detecting states of temperature and power source voltage of said timepiece, said detection means stopping an operation of the warning means if one of a detection value of the temperature and a detection value of the power source voltage deviates from a corresponding predetermined value, said detection means allowing the time clocking circuit to provide timing informations different from each other when the detection means detects a temperature lower than the predetermined value and when the detection means detects a voltage lower than the predetermined value, said timing informations being different from a timing of the time information in a normal state.

2. The electronic timepiece according to claim 1, wherein said timepiece state detection means includes a plurality of detection circuits, one of which is a timepiece temperature detection circuit for detecting the temperature.

3. The electronic timepiece according to claim 1, wherein said timepiece state detection means includes a plurality of detection circuits, one of which is a power source voltage detection circuit for detecting the power source voltage.

4. The electronic timepiece according to claim 1, wherein said warning means comprises buzzer based noise warning means and vibration motor based silent warning means.

5. The electronic timepiece according to claim 4, wherein if the temperature of said electronic timepiece detected by said detection means is a predetermined temperature or below, on action of said vibration motor based warning means is brought to a stop.

6. The electronic timepiece according to claim 5, wherein if the power source voltage of said electronic timepiece detected by said detection means is a predetermined voltage or below, the action of said buzzer based noise warning means is brought to a stop.

7. The electronic timepiece according to claim 2, wherein detection of the temperature of said electronic timepiece by said temperature detection circuit is carried out at a certain cycle on a basis of the signals from said reference signal generating circuit.

8. The electronic timepiece according to claim 3, wherein detection of the power source voltage at said electronic timepiece by said voltage detection circuit is carried out at a cycle different from a cycle of the temperature detection by said temperature detection circuit, on a basis of the signals from said reference signal generating circuit.

9. The electronic timepiece according to claim 1, wherein the timing of the time information in the normal state indicates one second for every second, said timing informations of the detection means being different in intervals for indicating time.

* * * * *